US006394302B1

(12) United States Patent
Query, Jr.

(10) Patent No.: US 6,394,302 B1
(45) Date of Patent: May 28, 2002

(54) DRINKING CUP WITH STRAW LID

(76) Inventor: Henry C. Query, Jr., 504 S. Pierce Ave., Wheaton, IL (US) 60187

( * ) Notice: Subject to any disclaimer, the term of this patent is extended or adjusted under 35 U.S.C. 154(b) by 0 days.

(21) Appl. No.: 09/706,905

(22) Filed: Nov. 6, 2000

Related U.S. Application Data

(63) Continuation-in-part of application No. 09/478,250, filed on Jan. 6, 2000, now Pat. No. 6,142,335.
(60) Provisional application No. 60/114,929, filed on Jan. 6, 1999.

(51) Int. Cl.[7] ..... A47G 19/22
(52) U.S. Cl. ..... 220/707; 220/709
(58) Field of Search ..... 200/707, 709, 200/705, 710

(56) References Cited

U.S. PATENT DOCUMENTS 4,811,860 A * 3/1989 Sorenson et al. ..... 220/707
5,579,948 A * 12/1996 Lin ..... 220/707
5,702,020 A * 12/1997 Larsen ..... 220/707
6,142,335 A * 11/2000 Query, Jr. ..... 220/707

* cited by examiner

*Primary Examiner*—Joseph M. Moy
(74) *Attorney, Agent, or Firm*—Henry C. Query, Jr.

(57) ABSTRACT

A lid for a drinking cup having a bottom and a sidewall extending generally upwardly from the bottom, the sidewall including an upper edge and an inner surface. The lid comprises a base, a mouthpiece which extends generally upwardly from the base and which has a longitudinal hole formed therethrough, and an elongated stem which depends generally downwardly from the base generally opposite the mouthpiece. The stem comprises two longitudinal side surfaces which are adapted to conform to the inner surface and a longitudinal channel which is formed between the side surfaces. The stem further comprises an upper portion, a lower portion and a spring element for hingedly connecting the lower portion to the upper portion and for biasing the lower portion radially outwardly relative to the upper portion. The channel communicates with the hole in the mouthpiece and, when the lid is secured to the cup, the side surfaces engage the inner surface to form a fluid passageway through which fluid in the cup may be extracted.

14 Claims, 7 Drawing Sheets

Fig. 1
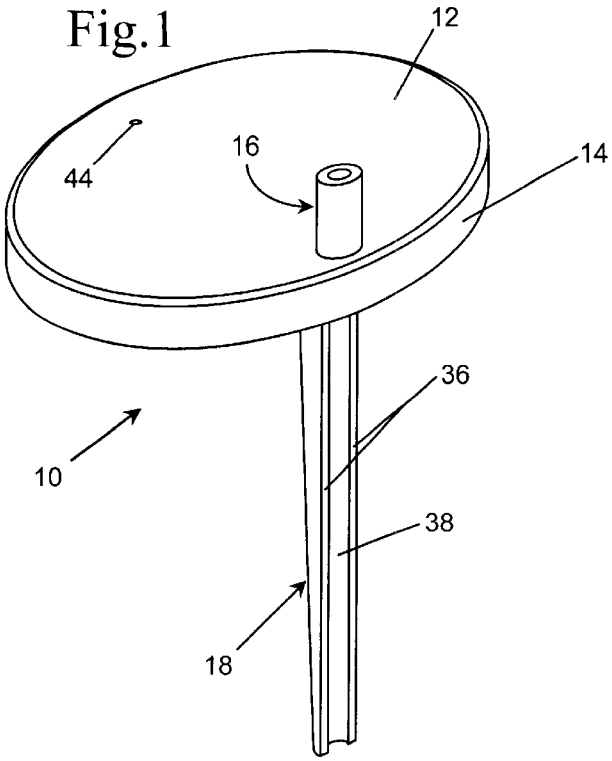
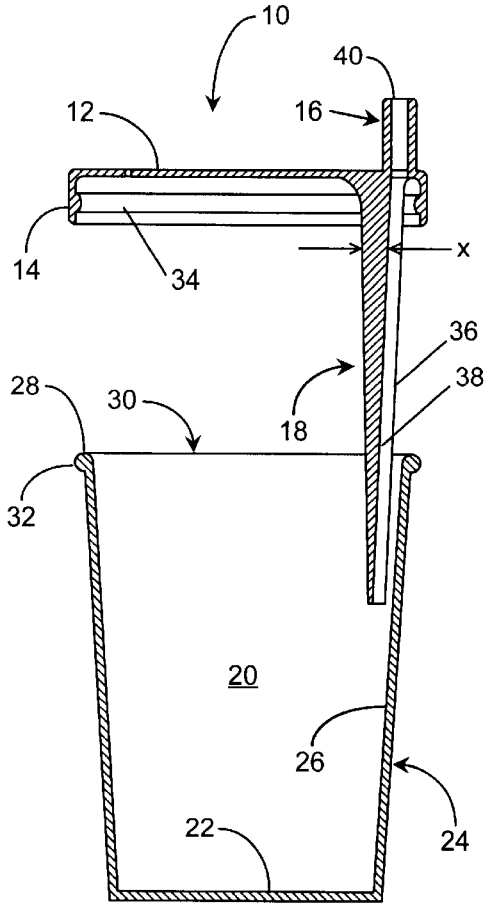
Fig. 2
Fig. 3
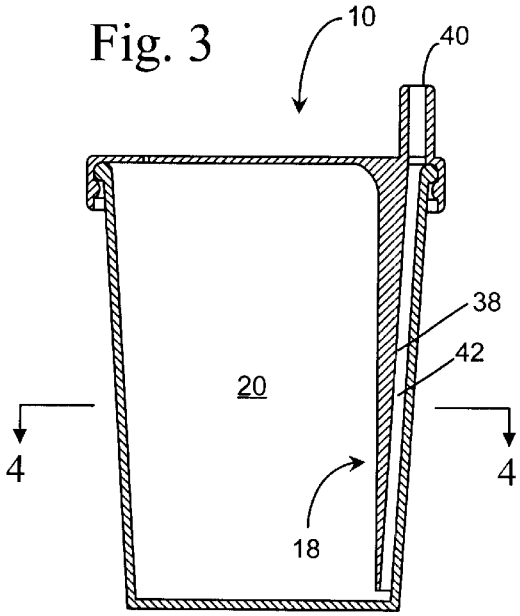

Fig. 4
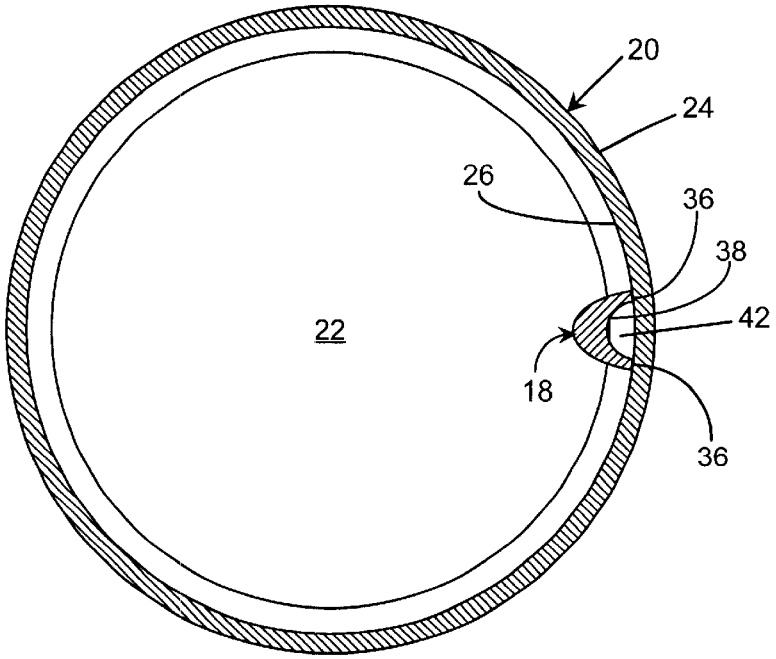
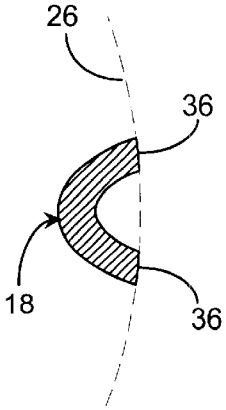
Fig. 7
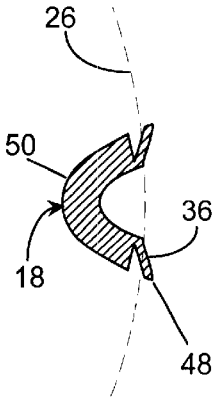
Fig. 7A
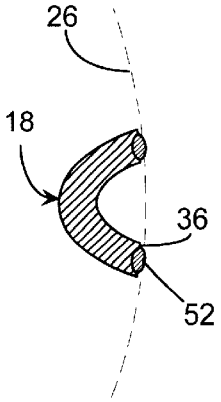
Fig. 7B
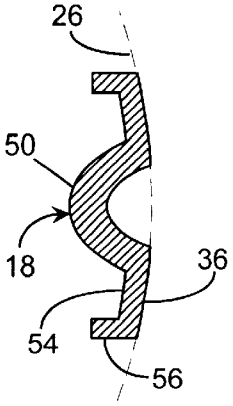
Fig. 7C Fig. 5
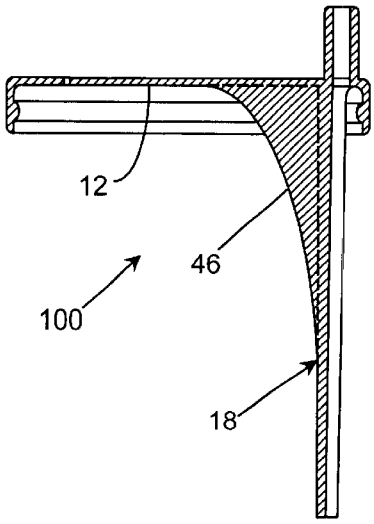
Fig. 6
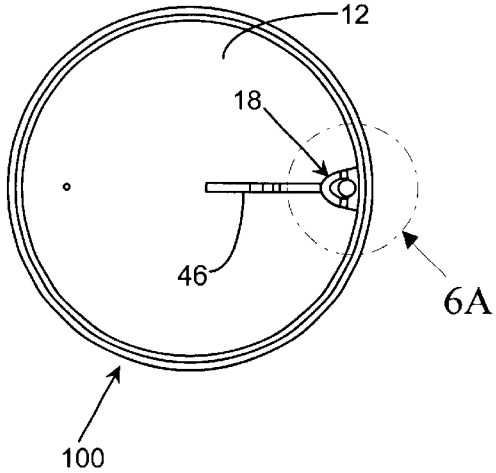
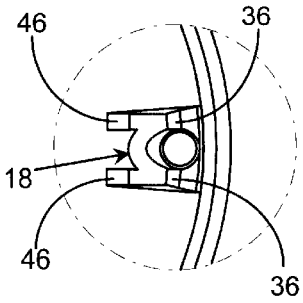
Fig. 6B
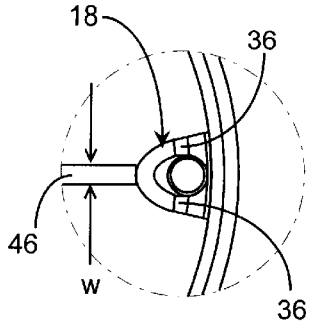
Fig. 6A Fig. 12
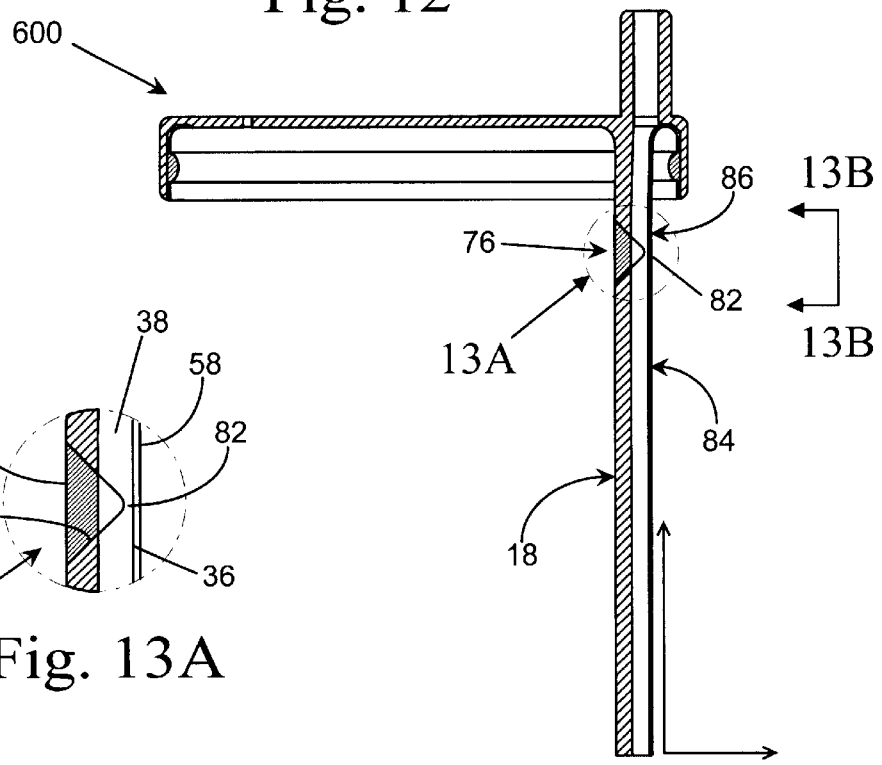
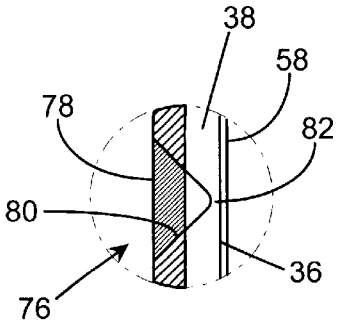
Fig. 13A
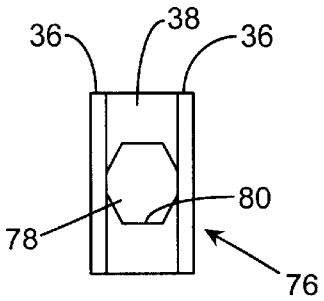
Fig. 13B
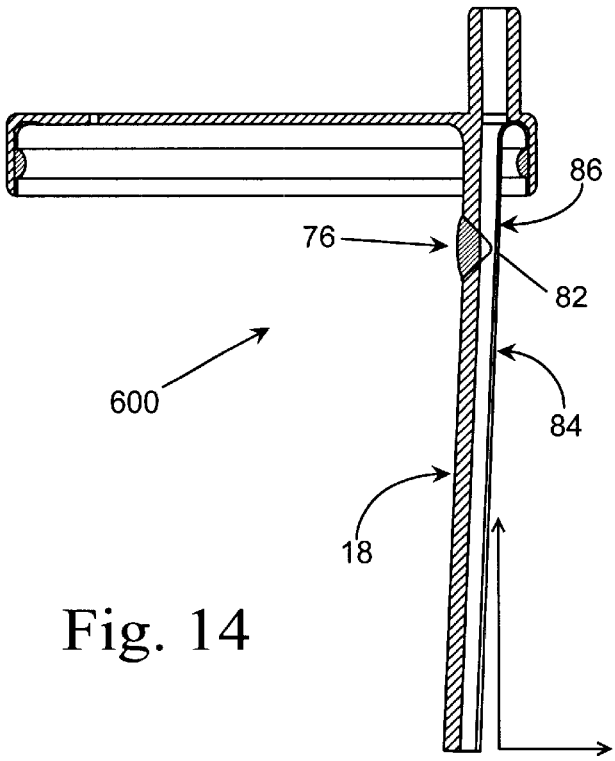
Fig. 14

DRINKING CUP WITH STRAW LID

This application is a continuation-in-part of U.S. patent application Ser. No. 09/478,250, which was filed on Jan. 6, 2000, now U.S. Pat. No. 6,142,335, which claims benefit of Provisional Pat. No. 6,114,929 filed Jan. 6, 1999.

BACKGROUND OF THE INVENTION

The present invention relates to lids for drinking cups. More particularly, the invention relates to a lid having a downwardly depending stem which, together with the inner surface of the cup, forms a straw through which fluid in the cup may be extracted.

Many prior art lids for drinking cups, particularly those marketed for use by children, include a straw which attaches to the bottom of the lid and a mouthpiece connected to the top of the lid opposite the straw. The mouthpiece includes a hole which communicates with the straw, and these two elements form a fluid passageway through which fluid in the cup may be extracted.

However, since these straws are elongated tubular objects, they are difficult to clean. In addition, because the straws are typically removably attached to the lid, they are subject to being misplaced.

SUMMARY OF THE INVENTION

In accordance with the present invention, these and other problems are overcome by providing a lid for a drinking cup which comprises a base, a rim which depends from the periphery of the base and which is adapted to be connected to the upper edge of the sidewall of a cup, a mouthpiece which extends generally upwardly from the base and has a longitudinal hole formed therethrough, and an elongated stem which depends generally downwardly from the base generally opposite the mouthpiece. The stem comprises a generally semi-circular cross section which forms two side surfaces, which are adapted to conform to the inner surface of the sidewall of the cup, and a longitudinal channel, which is formed between the side surfaces adjacent the inner surface. The channel communicates with the hole in the mouthpiece, and when the lid is secured to the cup, the side surfaces of the stem seal against the inner surface of the sidewall to enable the channel to form a fluid passageway through which fluid in the cup may be extracted.

In this manner, the stem and the sidewall of the cup function as a straw. However, since the channel is generally open when the lid is separated from the cup, it may be easily cleaned. Furthermore, since the stem is connected to the base of the lid, it is not subject to being misplaced.

In a preferred embodiment of the invention, the lid includes an active hinge member which connects a lower portion of the stem to an upper portion of the stem. The hinge member comprises a spring element which is designed to bias the lower portion radially outwardly relative to the upper portion. Thus, when the stem is inserted into the cup, the hinge member will urge the stem into sealing engagement with the side wall of the cup.

These and other objects and advantages of the present invention will be made apparent from the following detailed description of the preferred embodiments, with reference to the accompanying drawings. In the drawings, the same reference numbers are used to identify similar elements in the various embodiments.

BRIEF DESCRIPTION OF THE DRAWINGS

FIG. 1 is a perspective view of one embodiment of the lid of the present invention;

FIG. 2 is a longitudinal cross-sectional view of the lid of FIG. 1 shown being inserted into an exemplary cup;

FIG. 3 is a longitudinal cross-sectional view of the lid of FIG. 1 shown fully assembled with the exemplary cup;

FIG. 4 is a radial cross-sectional view of the lid and cup assembly taken along line 4—4 of FIG. 3;

FIG. 5 is a longitudinal cross-sectional view of another embodiment of the lid of the present invention;

FIG. 6 is a bottom view of the lid depicted in FIG. 5;

FIG. 6A is an enlarged view of a portion of the lid illustrated in FIG. 6;

FIG. 6B is an enlarged view similar to FIG. 6A, but showing an alternative embodiment of the lid of the present invention;

FIG. 7 is an exemplary radial cross-sectional view of the stem portion of the lid of the present invention;

FIGS. 7A through 7C are radial cross-sectional views similar to FIG. 7, but showing alternative embodiments of the stem portion of the lid of the present invention;

FIG. 12 is a longitudinal cross-sectional view of another embodiment of the lid of the present invention showing the stem portion in an un-flexed condition;

FIG. 13A is an enlarged view of a portion of the lid shown in FIG. 12;

FIG. 13B is a front elevation view of a portion of the lid taken along lines 13—13 of FIG. 12; and FIG. 14 is a longitudinal cross-sectional view of the lid of FIG. 12 showing the stem portion in a flexed condition.

DETAILED DESCRIPTION OF THE PREFERRED EMBODIMENTS

Figures 8, 8A:
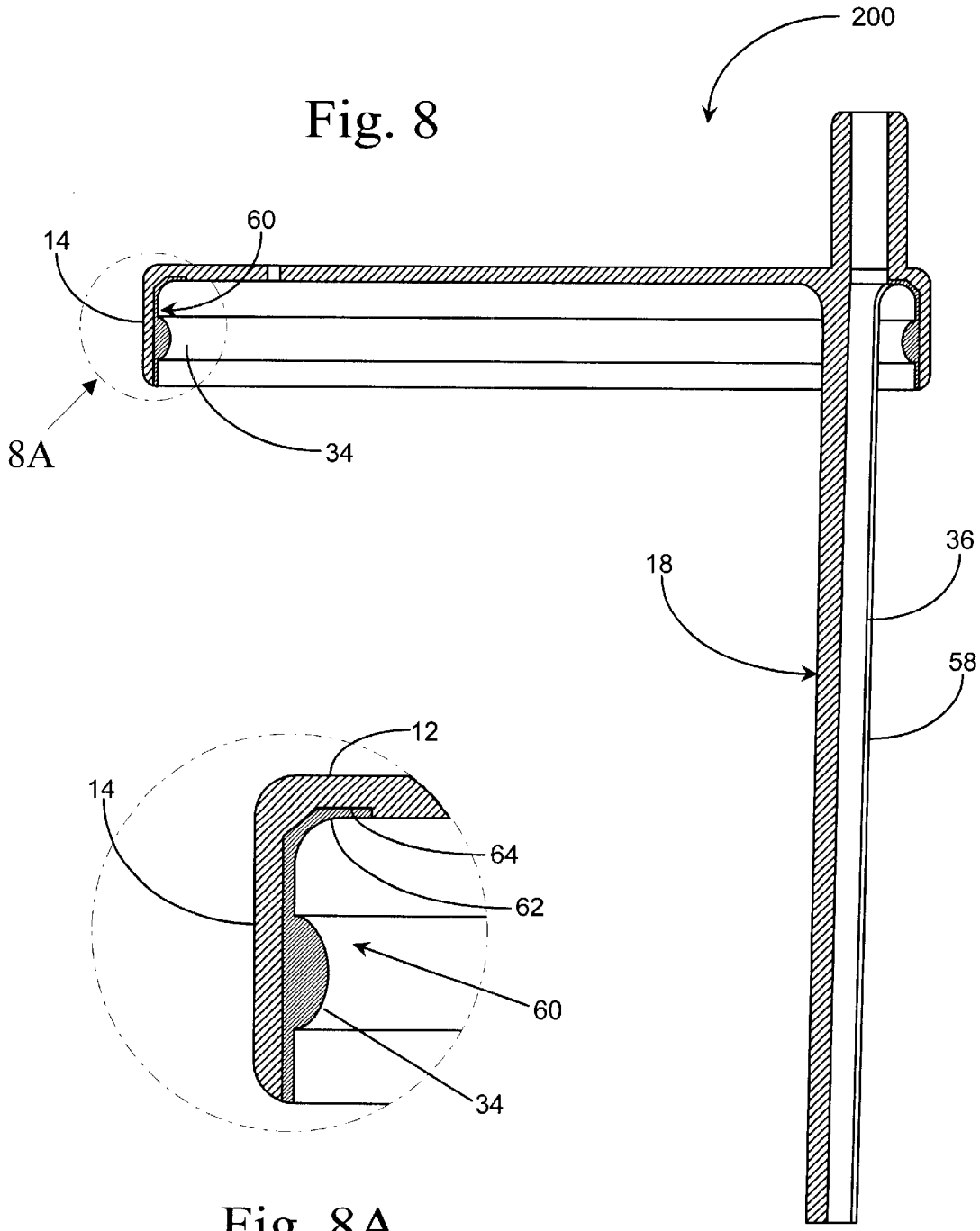
FIG. 8 is a longitudinal cross-sectional view of another embodiment of the lid of the present invention.
FIG. 8A is an enlarged view of a portion of the lid illustrated in FIG. 8.

Referring to FIG. 1, the drinking cup lid of the present invention, which is indicated generally by reference number 10, is shown to comprise a base 12, a rim 14 which depends downwardly from the periphery of base 12, a mouthpiece 16 which extends generally upwardly from base 12, and an elongated stem 18 which depends generally downwardly from base 12 generally opposite mouthpiece 16. The lid 10 is preferably made of a plastic material, such as Polypropylene, and is optimally manufactured as one piece in an injection molding process.

The lid 10 is adapted to be assembled with a drinking cup. Referring to FIGS. 2 and 3, an exemplary drinking cup 20 is shown to comprise a bottom 22 and an upstanding sidewall 24 having an inner surface 26 and an upper edge 28 defining a mouth or opening 30 of cup 20. The exemplary cup 20 typically also comprises an annular lip 32 protruding radially outwardly from the upper edge 28. Although cup 20 is shown to be generally cylindrical, it should be understood that the lid 10 of the present invention could be used in conjunction with various shaped cups. The shape of lid 10 is generally dictated by the shape of the mouth 30 of cup 20. Thus, in the Figures the base 12 and rim 14 of lid 10 are shown to be generally circular.

Various means may be provided to secure lid 10 to cup 20. In the embodiment depicted in FIGS. 1 through 3, the rim 14 of lid 10 includes a radial constriction 34 which is adapted to engage lip 32 and thereby firmly secure the lid 10 over the mouth 30, as shown in FIG. 3. Other means to secure lid 10 to cup 20 could include cooperating threads on both rim 14 and cup 20. Any other conventional means for securing a lid to a cup could also be used to secure lid 10 to cup 20.

Referring now to FIGS. 1 through 4, stem 18 is shown to comprise a generally elliptical or semi-circular radial cross section defining a pair of side surfaces 36, which are oriented to face the inner surface 26 of sidewall 24, and a longitudinal channel 38 formed between the side surfaces 36. The channel 38 extends substantially the entire length of stem 18 and communicates with a hole 40 formed through mouthpiece 16 and base 12. As shown more clearly in FIG. 4, side surfaces 36 are adapted to conform to and seal against the inner surface 26 of cup 20. Side surfaces 36 and inner surface 26 preferably form an interference fit when lid 10 is attached to cup 20 so as to ensure a fluid-tight seal between stem 18 and inner surface 26 along the length of channel 38. Thus, stem 18 preferably extends at a smaller angle from vertical than sidewall 24 so that side surfaces 36 will engage and be biased against inner surface 26 when lid 10 is attached to cup 20.

In this manner, when lid 10 is secured to cup 20, the side surfaces 36 and the inner surface 26 will form a fluid passageway 42 which communicates with the hole 40 in the mouthpiece 16 and through which fluid in the cup may be extracted. Thus, the stem 18 and the sidewall 24 of cup 20 function as a straw. However, since channel 38 is generally open when lid 10 is separated from cup 20, channel 38 and the lid 10 in general may be easily cleaned. Furthermore, since stem 18 is connected to the base 12, it is not subject to being misplaced. Finally, as shown more clearly in FIG. 1, lid 10 may also comprise a vent hole 44 formed in the base 12 to allow air to enter cup 20 when fluid is being sipped through the mouthpiece 16.

The construction of lid 10 preferably permits stem 18 to flex somewhat yet maintain a relatively strong bias against side wall 24 to ensure that side surfaces 36 firmly and sealingly engage the inner surface 26 when lid 10 is attached to cup 20. As shown in FIGS. 2 and 3, the radial cross section of stem 18 may have a thickness "x" which tapers from the upper end of stem 18 adjacent base 12 to the bottom end of stem 18. This will enable the lower portion of stem 18 to flex upon insertion into cup 20 and the upper portion of stem 18 to remain more rigid in order to sustain the bending force created by the interference fit between stem 18 and side wall 24.

Another embodiment of the invention is illustrated in FIGS. 5 and 6. The lid of this embodiment, which is designated generally by reference number 100, is similar in many respects to the lid 10 depicted in FIGS. 1 through 4. However, in lid 100 the thickness "x" of the radial cross section of stem 18 is preferably generally constant from the top to the bottom of stem 18. In order to provide radial support for stem 18, lid 100 comprises a support rib 46 extending between stem 18 and the underside of base 12. Rib 46 permits stem 18 to flex somewhat yet maintain a relatively strong bias against side wall 24 when lid 100 is secured to cup 20. While the rib 46 is shown extending radially from stem 18 to approximately the center of base 12, the particular design of lid 100 may require rib 46 to extend more or less than shown. Similarly, although rib 46 is shown to terminate approximately midway down the longitudinal extent of stem 18, it may extend more or less, including substantially to the bottom of stem 18.

The rib 46 is preferably formed integrally with lid 100 in an injection molding process. In addition, as shown more clearly in FIG. 6A, rib 46 preferably has a width "w" approximately the same as the thickness "x" of the cross section of stem 18. Thus, when lid 100 is inserted into cup 20, the bending forces imparted on stem 18 will be transmitted from the side surfaces 36, through the semi-circular cross section of stem 18 and into rib 46. Since rib 46 is relatively rigid in the radial direction, it will maintain the side surfaces 36 of stem 18 in firm contact with the side wall 24 of cup 20.

In accordance with another embodiment of the invention, which is depicted in FIG. 6B, lid 100 may be provided with two ribs 46. In this embodiment, each rib 46 is connected to the stem 18 opposite a side surface 36. In this manner, the bending forces imparted on stem 18 will be transmitted directly from the side surfaces 36 to the ribs 46.

In accordance with the preferred embodiment of the invention, the side surfaces 36 of stem 18 are designed to sealingly engage the inner surface 26 of the side wall 24 of cup 20. Referring to FIG. 7, which is an exemplary radial cross-sectional view of a stem 18 similar to that shown in FIG. 5, the side surfaces 36 are shown formed with a radius substantially the same as the radius of the inner surface 26. In this manner, the side surfaces 36 will conform to the inner surface 26 and form a fluid tight seal therewith.

In an alternative embodiment of the stem 18, which is depicted in FIG. 7A, each side surface 36 is formed on a wing 48 which is hingedly connected to the body portion 50 of stem 18. In this manner, as stem 18 is forced against the inner surface 26 the wings 48 will bend to conform to the inner surface 26. This bending moment will maintain an additional sealing force between side surfaces 36 and inner surface 26. The wings 48 may be provided substantially the entire length of stem 18, or for only a portion thereof beginning at the bottom of stem 18. It should be noted that, in FIG. 7A wings 48 are shown extending beyond inner surface 26 for purposes of clarity only.

In another alternative embodiment of the stem 18, which is illustrated in FIG. 7B, the lid of the present invention may include a pair of seals 52 extending longitudinally along each side surface 36 preferably substantially the entire length of the stem 18. The seals 52 may be formed integrally with the stem 18 or manufactured separately and affixed to the side surfaces 36 by any suitable means, such as an appropriate adhesive. In addition, while the seals 52 may be constructed of the same material as the lid, they are preferable made of a more resilient material.

In yet another embodiment of the stem 18, which is shown in FIG. 7C, each side surface 36 is formed on a side wall 54 extending laterally from the body portion 50 of the stem 18. This results in the side surfaces 36 having a lateral extent which is greater than in previous embodiments. Consequently, the side surfaces 36 have a greater sealing area and are thus better able to accommodate any imperfections in the inner surface 26 which could otherwise prevent an effective seal. The stem 18 of this embodiment may also comprise one or more ribs 56 to provide radial support for the side walls 54.

Referring now to FIG. 8, another embodiment of the lid of the present invention, indicated generally by reference number 200, is shown to comprise a stem 18 having a overlay 58 applied to each side surface 36. The overlay 58 is preferably a relatively soft elastomer material that is joined with stem 18 in the final step of a dual injection molding process. The overlay 58 allows the lid 200 to be constructed of a relatively stiff material so that the stem 18 will be maintained tightly against the side wall 24 in an interference fit without the need for ribs or a thick radial cross section. In addition, the overlay 58 provides for better sealing against inner surface 26 than a stiffer plastic material.

In order to allow the lid 200 to be constructed of a stiffer material but still be easily connected and disconnected from a cup 20, the lid 200 may also be provided with a snap ring 60 connected to the inner surface of the rim 14. The snap ring 60 is preferably constructed of a soft, flexible plastic or elastomer material, and may be made of the same material as overlay 58 and joined to lid 200 in the same step of the dual injection molding process. The snap ring 60 comprises the constriction 34 which is designed to engage the lip 32 to secure the lid 200 to the cup 20. Since constriction 34 is made of a relatively flexible material, the lid 200 may be easily connected to and removed from the cup 20. As seen more clearly in FIG. 8A, snap ring 60 also contains an upper portion or gasket 62 which is received within a corresponding recess 64 formed in the underside of base 12. Gasket 62 aides in sealing the lid 200 to the rim 28 of the cup 20 to prevent leakage.

Figure 8B:
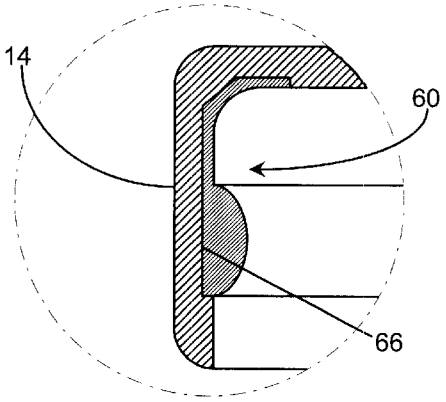
FIGS. 8B through 8E are enlarged views similar to FIG. 8A, but showing alternative embodiments of the lid of the present invention.
Figure 8C:
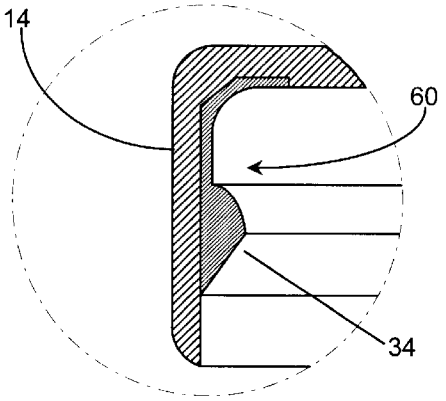
Figure 8D:
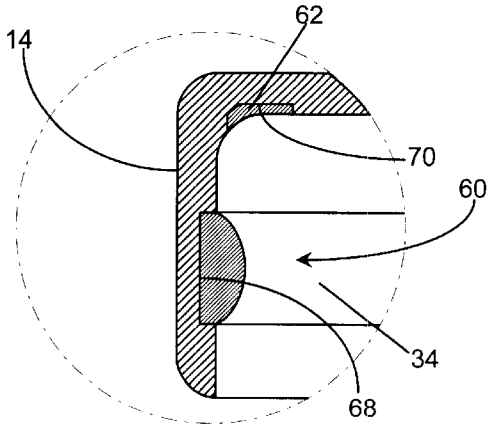
Figure 8E:
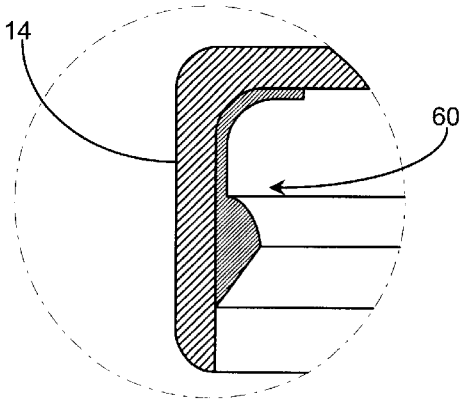

FIGS. 8B through 8E illustrate various alternative embodiments of snap ring 60. In FIG. 8B, snap ring 60 is received in a corresponding recess 66 formed in the inner surface of rim 14. In this manner, snap ring 60 is more securely affixed to rim 14. In FIG. 8C, snap ring 60 terminates below constriction 34 in order to reduce the amount of material employed. In FIG. 8D, snap ring 60 comprises only a radial constriction 34, which is received in a corresponding recess 68 formed in rim 14, and a separate gasket 62, which is received in a corresponding recess 70 formed in base 12. In this alternative, the amount of material employed for snap ring 60 is even further reduced. In FIG. 8E snap ring 60 is similar to that shown in FIG. 8C; but in this variation no portion of snap ring 60 is received in a recess formed in the lid 200. Thus, construction of the lid 200 of this embodiment is simplified.

Figure 9:
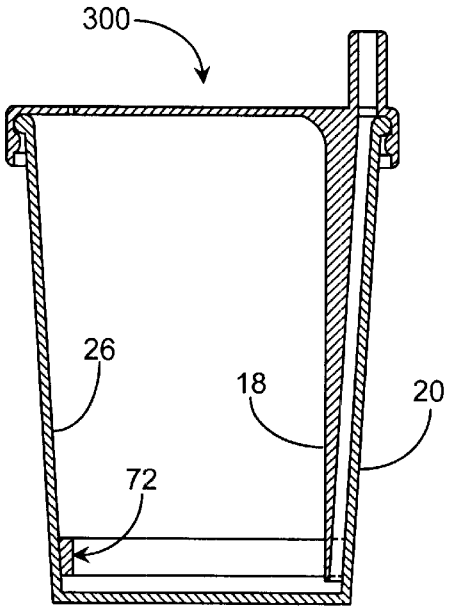
FIG. 9 is a longitudinal cross-sectional view of another embodiment of the lid of the present invention.

Referring to FIG. 9, another embodiment of the invention is shown. In this embodiment the lid, which is indicated generally by reference number 300, comprises an annular compression ring 72 connected to the bottom portion of stem 18. When lid 300 is inserted into cup 20, compression ring 72 will react against the inner surface 26 opposite the stem 18 to force the stem into sealing engagement with the inner surface 26 adjacent the side surfaces 36.

Figure 10:
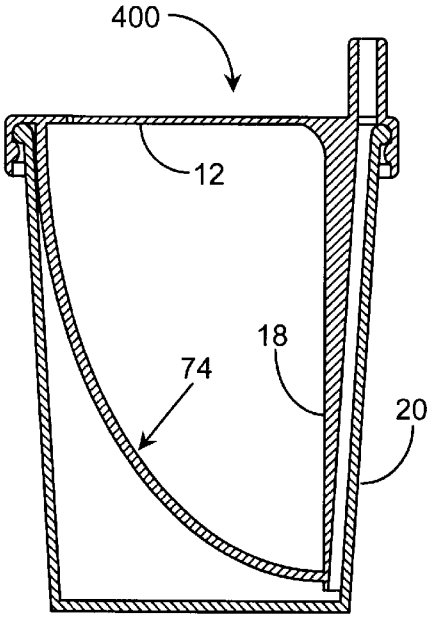
FIG. 10 is a longitudinal cross-sectional view of still another embodiment of the lid of the present invention.

Another embodiment of the invention is depicted in FIG. 10. In this embodiment the lid, which is indicated generally by reference number 400, comprises a compression band 74 extending between the base 12 and the bottom portion of the stem 18. In this manner, when lid 400 is secured to cup 20, compression band 74 will force the bottom portion of stem 18 into sealing engagement with the inner surface 26 of the cup 20.

Figure 11:
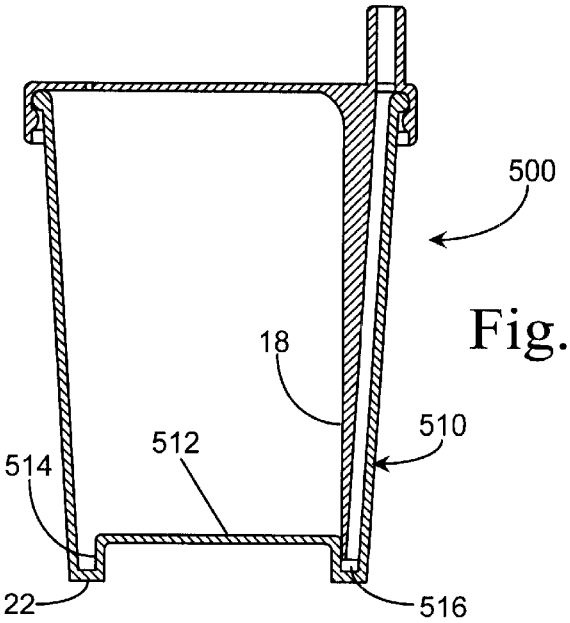
FIG. 11 is a longitudinal cross-sectional view of yet another embodiment of the lid of the present invention.

Yet another embodiment of the invention is depicted in FIG. 11. In this embodiment the lid and cup form an assembly 500. The lid of assembly 500 is similar to those of previous embodiments. However the cup, which is indicated generally by reference number 510, comprises a bottom 22 having a raised ring portion 512. The ring portion 512 comprises an outer diameter 514 which forms a trough 516 with the side wall 24 of the cup 510. The width of the trough 516 is designed to be slightly less than the width of the bottom portion of the stem 18. Thus, when the lid is secured to the cup 510, the bottom portion of the stem 18 will be received in the trough 516 and the side surfaces will be forced against the inner surface of the cup 510.

Yet another embodiment of the present invention is illustrated in FIG. 12. The lid of this embodiment, which is indicated generally by reference number 600, is similar in many respects to the lid shown in FIG. 8. However, in this embodiment the lid 600 comprises a hinge member 76 to actively bias the stem 18 into sealing engagement with the side wall of the cup. Referring to FIGS. 13A and 13B, the hinge member is shown to comprise a spring element 78 which is received in a cutout portion 80 of the stem 18. The spring element 78 is preferably made of a resilient elastomer material, such as the same material as the overlay 58 discussed above. Ideally, the spring element 78 is molded into the cutout portion 80 in the second step of a dual injection molding process. More preferably, the spring element 80 is molded into the lid 600 during the same step used to form the overlay 58. As seen in the Figures, the spring element conforms to the shape of the channel 38 so as not to interfere with the flow of fluid through the channel.

The cutout portion 80 optimally extends radially around the stem 18 from proximate one side surface 36 to proximate the other side surface 36, thereby forming a thin neck portion 82 adjacent each side surface. The neck portion is constructed of the same material as the stem 18, for example, plastic, and joins a lower portion 84 of the stem with an upper portion 86 of the stem. In this manner, the lower portion 84 is permitted to flex radially with respect to the upper portion 86 to allow the stem to conform to the side wall of the cup (not shown).

As shown in FIG. 12, the spring element 78 is designed to bias the lower portion 84 of the stem 18 radially outwardly relative to the upper portion 86. Thus, when adapted to conform to a cup having a side wall which is angled slightly, for example 6° with respect to vertical, the angle of the upper portion 86 is preferably approximately the same as the angle of the side wall and the angle of the lower portion 84 is optimally approximately zero degrees relative to vertical. As illustrated in FIG. 14, when the lid is inserted into the cup (not shown), the lower portion 84 of the stem will rotate about the hinge member 76 until the lower portion is in conformance with the side wall, and the more flexible spring element 78 will be compressed between the upper and lower stem portions. The spring element 78 will in turn exert a proportionately greater radially outward force on the lower portion to urge the side surfaces 36 firmly against the side wall.

It should be recognized that, while the present invention has been described in relation to the preferred embodiments thereof, those skilled in the art may develop a wide variation of structural and operational details without departing from the principles of the invention.

What is claimed is:

1. A lid for a drinking cup having a bottom and a sidewall extending generally upwardly from the bottom, the sidewall including an upper edge and an inner surface, the lid comprising:

a base;

a rim which depends from the periphery of the base and which includes means for removably connecting the base to the cup over the upper edge;

a mouthpiece which extends generally upwardly from the base and which has a longitudinal hole formed therethrough;

an elongated stem which depends generally downwardly from the base generally opposite the mouthpiece;

the stem comprising two longitudinal side surfaces which are adapted to conform to the inner surface and a longitudinal channel formed between the side surfaces;

the stem further comprising an upper portion, a lower portion and means for hingedly connecting the lower portion to the upper portion and for biasing the lower portion radially outwardly relative to the upper portion;

wherein the channel communicates with the hole in the mouthpiece and, when the lid is secured to the cup, the side surfaces engage the inner surface to form a fluid passageway through which fluid in the cup may be extracted.

2. The lid of claim 1, wherein the hinged connecting means comprises a spring element which is received in a cutout portion of the stem that is disposed between the upper portion and the lower portion.

3. The lid of claim 2, wherein the spring element comprises a resilient elastomer material.

4. The lid of claim 3, further comprising:

an overlay which is attached to each side surface;

wherein the overlay and the spring element are comprised of the same material.

5. A lid for a drinking cup which comprises a sidewall having an upper edge and an inner surface, the lid comprising:

a base which is connectable to the cup over the upper edge;

a mouthpiece which is connected to the base and which includes a longitudinal hole formed therethrough;

an elongated stem which is connected to the base generally opposite the mouthpiece;

the stem comprising two longitudinal side surfaces which are adapted to conform to the inner surface and a longitudinal channel which is formed between the side surfaces and communicates with the hole in the mouthpiece;

the stem further comprising a lower portion which is hingedly connected to an upper portion;

wherein when the lid is secured to the cup, the side surfaces engage the inner surface to form a fluid passageway through which fluid in the cup may be extracted.

6. The lid of claim 5, further comprising means for biasing the lower portion of the stem radially outwardly relative to the upper portion.

7. The lid of claim 6, wherein the biasing means comprises a spring element which is disposed between the upper and lower portions.

8. The lid of claim 7, wherein the spring element comprises a resilient elastomer material.

9. The lid of claim 8, further comprising:

an overlay which is attached to each side surface;

wherein the overlay and the spring element are comprised of the same material.

10. In combination with a drinking cup comprising a sidewall having an upper edge and an inner surface, a lid which comprises:

a base which is connectable to the cup over the upper edge;

a mouthpiece which is connected to the base and which includes a longitudinal hole formed therethrough;

an elongated stem which is connected to the base generally opposite the mouthpiece;

the stem comprising two longitudinal side surfaces which are adapted to conform to the inner surface and a longitudinal channel which is formed between the side surfaces and communicates with the hole in the mouthpiece;

the stem further comprising a lower portion which is hingedly connected to an upper portion;

wherein when the lid is secured to the cup, the side surfaces engage the inner surface to form a fluid passageway through which fluid in the cup may be extracted.

11. The lid of claim 10, further comprising means for biasing the lower portion of the stem radially outwardly relative to the upper portion.

12. The lid of claim 11, wherein the biasing means comprises a spring element which is disposed between the upper and lower portions.

13. The lid of claim 12, wherein the spring element comprises a resilient elastomer material.

14. The lid of claim 13, further composing:

an overlay which is attached to each side surface;

wherein the overlay and the spring element are comprised of the same material.

* * * * *